US005589443A

United States Patent [19]

Denton et al.

[11] Patent Number: 5,589,443

[45] Date of Patent: Dec. 31, 1996

[54] ROCK BIT GREASE COMPOSITION

[75] Inventors: Robert M. Denton, Friendswood; Zhigang Fang, The Woodlands, both of Tex.

[73] Assignee: Smith International, Inc., Houston, Tex.

[21] Appl. No.: 576,617

[22] Filed: Dec. 21, 1995

[51] Int. Cl.[6] ..... C10M 125/00; C10M 169/00

[52] U.S. Cl. ..... 508/150; 508/155; 508/167; 508/169; 175/227; 175/228

[58] Field of Search ..... 252/18, 19

[56] References Cited

U.S. PATENT DOCUMENTS

| | | | |
|---|---|---|---|
| 2,990,025 | 6/1961 | Talbert et al. | 175/375 |
| 3,727,705 | 4/1973 | Newman | 175/374 |
| 3,935,114 | 1/1976 | Donaho, Jr. | 252/18 |
| 4,320,017 | 3/1982 | Spence | 252/43 |
| 4,358,384 | 11/1982 | Newcomb | 252/19 |
| 4,409,112 | 10/1983 | Urmy, Jr. | 252/33.4 |
| 4,507,214 | 3/1985 | Aldorf | 252/18 |
| 4,634,545 | 1/1987 | Zaleski et al. | 252/29 |
| 4,840,740 | 6/1989 | Sato et al. | 252/32.7 |
| 4,842,752 | 6/1989 | Hardy et al. | 252/17 |
| 4,877,557 | 10/1989 | Kaneshige et al. | 252/56 |
| 4,912,272 | 3/1990 | Wu | 585/10 |
| 4,956,122 | 9/1990 | Watts et al. | 252/565 |
| 4,986,923 | 1/1991 | Waynick | 252/25 |
| 5,015,401 | 5/1991 | Landry et al. | 252/18 |
| 5,037,564 | 8/1991 | Nishizaki et al. | 252/22 |
| 5,037,567 | 8/1991 | Farng et al. | 252/32.7 |
| 5,089,156 | 2/1992 | Chrisope et al. | 252/49.9 |
| 5,104,579 | 4/1992 | Benjamin et al. | 252/46.6 |
| 5,105,038 | 4/1992 | Chen et al. | 585/10 |
| 5,110,489 | 5/1992 | Stadler et al. | 252/35 |
| 5,194,621 | 3/1993 | Karol et al. | 548/142 |
| 5,462,683 | 10/1995 | Kinoshita et al. | 252/25 |
| 5,512,188 | 4/1996 | Kinoshita et al. | 252/18 |

FOREIGN PATENT DOCUMENTS

| | | |
|---|---|---|
| 0191608 | 8/1985 | European Pat. Off. . |
| 0492458A2 | 7/1992 | European Pat. Off. . |
| 0511547A2 | 11/1992 | European Pat. Off. . |

OTHER PUBLICATIONS

C. V. Smalheer et al., *Lubricant Additives,* The Lezius–Hils Co., Cleveland, Ohio, 1967, pp. 1–11.

Brochure "Amoco Polybutene," Amono Chemical Company Bulletin 12–M, 1990 (month N/A).

"Hydrocarbon–Based Synthetic Oil" Lucant, Mitsui Petrochemical, Jun. 1986, 12 pages.

An Introduction to Vistanex LM Low Molecular Weight Polyisobutylene, Exxon Chem., Sep. 1992.

*Primary Examiner*—Ellen M. McAvoy

*Attorney, Agent, or Firm*—Christie, Parker & Hale, LLP

[57] ABSTRACT

A rock bit grease composition is prepared by combining synthetic polymer lubricant basestocks comprising a first ethylene-alphaolefin polymer having an average molecular weight in the range of from 3,500 to 4,000, and a polyisobutylene polymer to form a first master. A metal complex soap base thickener is prepared by combining a synthetic polymer lubricant basestocks comprising a second ethylene-alpha-olefin having an average molecular weight in the range of from 400 to 800, with an alkali-metal or alkaline-earth metal hydroxide, and at least one fatty acid. A preferred fatty acid is a blend of a first fatty acid having in the range of from 15 to 20 carbon atoms, and a second fatty acid having in the range of from 5 to 12 carbon atoms. The first master and metal complex soap base thickener are mixed together in desired proportions. Boron nitride extreme pressure agent, molybdenum disulfide lubricant additive, and copper powder anti-seize agent are added to the mixture to produce a grease composition having a Brookfield viscosity at 120° C. in the range of from 600 to 750 centipoise, that is not harmful to elastomeric rock bit seals and boots, and that is free of metal lubricant additives that are toxic to humans and/or hazardous to the environment.

35 Claims, 1 Drawing Sheet

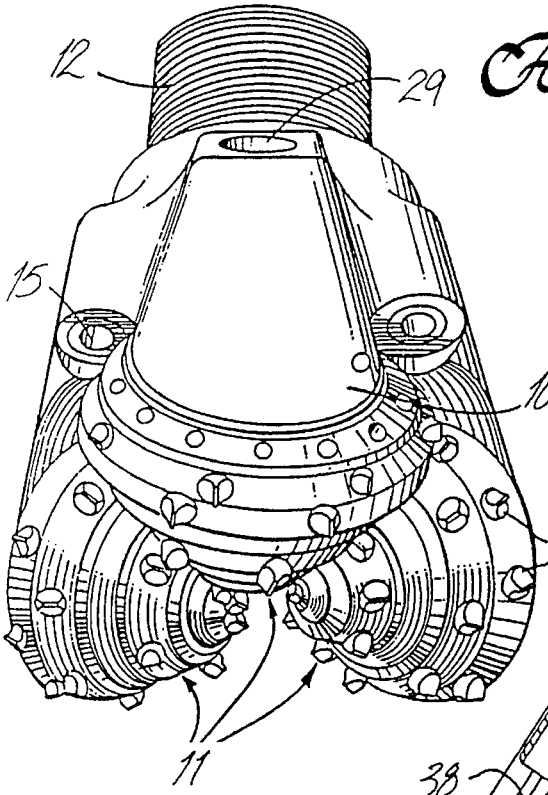
Fig. 1
Fig. 2
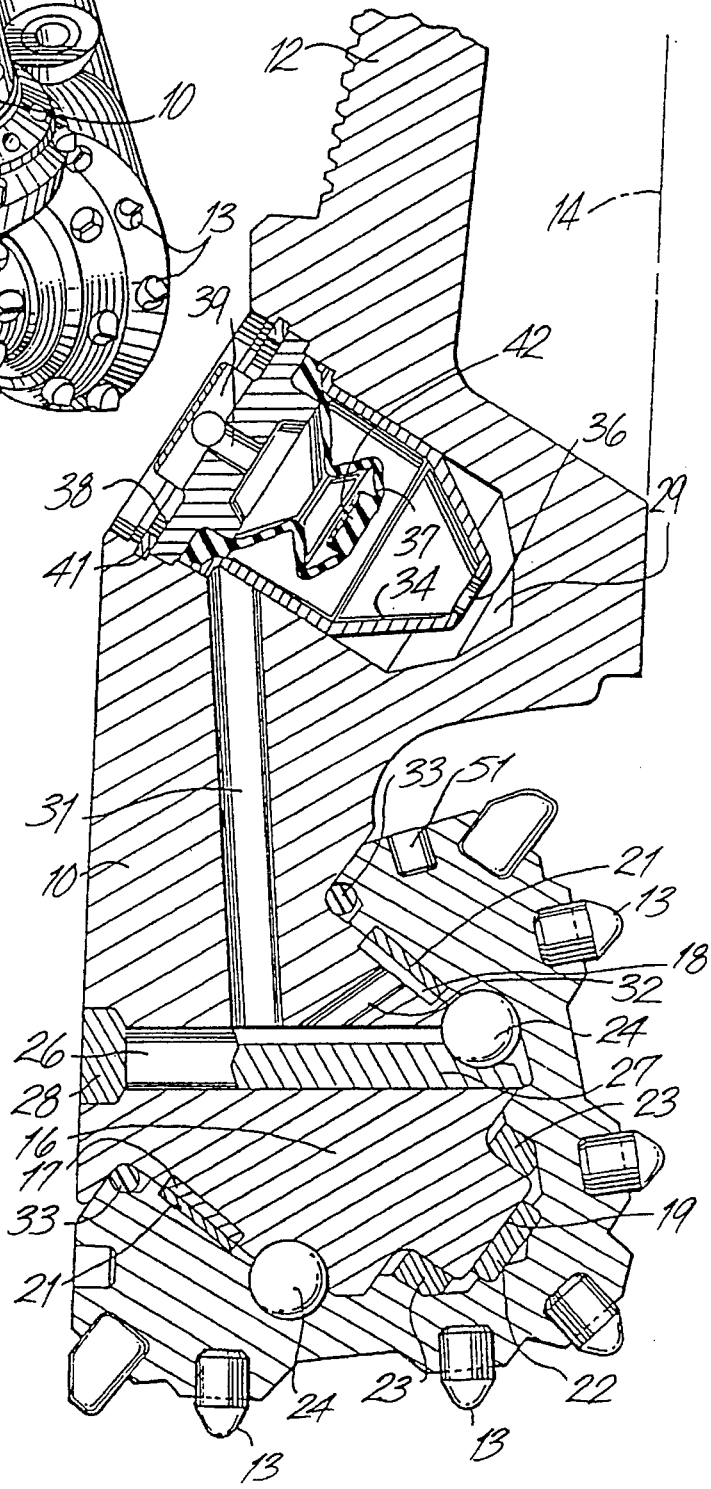

ROCK BIT GREASE COMPOSITION

FIELD OF THE INVENTION

This invention relates to grease compositions for lubricating journal bearings in rock bits for drilling oil wells or the like and, more particularly, relates to grease compositions comprising synthetic lubricant basestocks and a boron nitride extreme pressure additive.

BACKGROUND OF THE INVENTION

Heavy duty rock bits are employed for drilling wells in subterranean formations for oil, gas, geothermal steam and the like. Such bits have a body connected to a drill string and a plurality, typically three, of hollow cutter cones mounted on the body for drilling rock formations. The cutter cones are mounted on steel journals or pins integral with the bit body at its lower end. In use, the drill string and bit body are rotated in the bore hole, and each cone is caused to rotate on its respective journal as the cone contacts the bottom of the bore hole being drilled. While such a rock bit is used in hard, tough formations, high pressures and temperatures are encountered. The total useful life of a rock bit in such severe environments is in the order of 20 to 200 hours for bits in sizes of about 6 to 28 inch diameter at depths of about 5000 to 20,000 feet. Useful lifetimes of about 65 to 150 hours are typical.

When a rock bit wears out or fails as a bore hole is being drilled, it is necessary to withdraw the drill string for replacing the bit. Prolonging the time of drilling minimizes the lost time in "round tripping" the drill string for replacing bits.

Replacement of a drill bit can be required for a number of reasons, including wearing out or breakage of the structure contacting the rock formation. One reason for replacing the rock bits includes failure or severe wear of the journal bearings on which the cutter cones are mounted. The journal bearings are lubricated with grease adapted to severe conditions. Another reason for replacing rock bits include failure of elastomeric seals and/or boots that are used to retain the grease between the cone and the journal pin. The journal bearings are subjected to very high pressure drilling loads, high hydrostatic pressures in the hole being drilled, and high temperatures due to drilling, as well as elevated temperatures in the formation being drilled. Considerable development work has been conducted over the years to produce bearing structures and employ materials that minimize wear and failure of such bearings.

A variety of grease compositions have been employed in the past. Such grease compositions comprise a generally low viscosity, refined petroleum or hydrocarbon oil basestock which provides the basic lubricity of the composition and may constitute about ¾ of the total grease composition. Such basestock oil is thickened with a conventional metal soap or metal complex soap, wherein the metal is aluminum, barium, calcium, lithium, sodium, or strontium. Silica thickener systems may also be used alone or in combination with the metal or metal complex soap thickener. In order to enhance the film lubricating capacity of such petroleum basestock greases, solid additives such as molybdenum disulfide, copper, lead or graphite must be added. Synthetic polymer extreme pressure agents (EPAs) are also used. Such additives serve to enhance the ability of the lubricant basestock to form a film between the moving metal surfaces under conditions of extreme pressure.

U.S. Pat. Nos. 3,062,741, 3,107,878, 3,281,355, and 3,384,582 each disclose the use of molybdenum disulfide, and other solid additives such as copper, lead and graphite which have been employed in an attempt to enhance the lubrication properties of oils and greases. It is also known to include metallic oxides like zinc oxide in lubrication oils.

U.S. Pat. No. 2,736,700 describes the use of molybdenum disulfide and a metallic oxide, such as fumed lead oxide and zinc oxide in a ratio of two parts molybdenum disulfide to one part metallic oxide, in a paint composition, or bonded lubricant containing a lacquer drying agent. Such bonded lubricants are inadequate and can not be used in the heavily loaded applications for which this invention is intended.

However, the use of such conventional solid EPAs have been shown to contribute to rock bit seal failure. For example, rock bit lubricant compounds comprising an EPA formed from copper have displayed seal failures due to copper deposits and loading near the seal area. The copper accumulates near the seal area until the seal is abraded by the constant and progressive erosive contact with the copper deposit. The abraded seal eventually loses its capacity to retain the grease composition in the journal area, permitting metal to metal contact between the cone and journal that eventually causes rock bit failure.

Also, in today's society of heightened environmental awareness, the use of solid EPAs that are made from heavy metal complexes are not desirable due to their toxicity and environmental impact. For example, popular solid EPAs that care formed from lead must now be treated as a toxic material during manufacturing and during use of the rock bit. The use of such toxic materials during both the manufacturing and use of the rock bit presents a potential environmental hazard with respect to the manufacture, storage, use and final disposal of the rock bit.

Additionally, the use of sulfur-based EPAs have been found to degrade elastomeric seals and boots of the rock bit that are formed from nitrile rubber. It has been discovered that at high temperatures, the sulfur in such EPAs react with the nitrile rubber seals and boots via vulcanization reaction, causing the seals and boots to become brittle and easily tear, thereby, contributing to premature seal and/or boot related rock bit failure.

It is, therefore, desirable to provide a grease composition for lubricating rock bits that protects the journal bearing surfaces from premature wear or failure during service at the high temperatures, bearing pressures and rotational speeds often found in modern rock bits. It is also desirable that the grease composition promote optimum sealing and not be harmful to rock bit seals and boots. It is further desirable that the grease composition be free of metal lubricant additives that can be toxic to humans and/or hazardous to the environment.

BRIEF SUMMARY OF THE INVENTION

There is, therefore, provided in practice of this invention according to a presently preferred embodiment, a silica-free grease composition for lubricating rock bits used for drilling subterranean formations. The grease composition comprises synthetic polymer lubricant basestocks, a metal complex soap base thickener, boron nitride extreme pressure agents, molybdenum disulfide lubricating additive, and copper powder anti-seize agent.

The grease composition is prepared by combining synthetic polymer lubricant basestocks comprising a first ethylene-alphaolefin polymer having an average molecular weight in the range of from 3,500 to 4,000, and a polyisobutylene polymer having a Flory molecular weight in the range of from 42,000 to 68,000 to form a first master. The first master comprises in the range of from 95 to 99 percent by weight first ethylene-alphaolefin polymer, 1 to 5 percent by weight polyisobutylene ingredient.

A metal complex soap base thickener is prepared by combining a synthetic polymer lubricant basestock comprising a second ethylene-alphaolefin having an average molecular weight in the range of from 400 to 800, with an alkali-metal or alkaline-earth metal hydroxide, and at least one fatty acid. A preferred fatty acid is a blend of a first fatty acid having in the range of from 15 to 20 carbon atoms, and a second fatty acid having in the range of from 5 to 12 carbon atoms. The metal complex soap base thickener comprises in the range of from 75 to 90 percent by weight second ethylene-alphaolefin polymer, one to five percent alkali-metal or alkaline-earth metal hydroxide, 5–5 percent by weight first fatty acid, and 1 to 5 percent by weight second fatty acid.

The first master and metal complex soap base thickener are mixed together in sufficient amounts so that the grease composition comprises in the range of from 45 to 55 percent by weight first master, and 35 to 45 percent by weight metal complex soap base thickener. Boron nitride extreme pressure agent, molybdenum disulfide lubricant additive, and copper powder anti-seize agent is added to the mixture to produce a grease composition having a Brookfield viscosity at 120° C. in the range of from 600 to 750 centipoise, that is not harmful to elastomeric rock bit seals and boots, and that is free of metal lubricant additives that are toxic to humans and/or hazardous to the environment.

BRIEF DESCRIPTION OF THE DRAWINGS

A rock bit that is lubricated with a grease composition prepared according to principles of this invention is illustrated in semi schematic perspective in FIG. 1, and in a partial cross section in FIG. 2.

DETAILED DESCRIPTION

A rock bit employing a grease composition, prepared according to principles of this invention, comprising synthetic high-viscosity lubricant basestocks and one or more solid extreme pressure additives (EPAs,) comprises a body 10 having three cutter cones 11 mounted on its lower end. A threaded pin 12 is at the upper end of the body for assembly of the rock bit onto a drill string for drilling oil wells or the like. A plurality of tungsten carbide inserts 13 are pressed into holes in the surfaces of the cutter cones for bearing on the rock formation being drilled. Nozzles 15 in the bit body introduce drilling mud into the space around the cutter cones for cooling and carrying away formation chips drilled by the bit.

FIG. 2 is a fragmentary, longitudinal cross section of the rock bit, extending radially from the rotational axis 14 of the rock bit through one of the three legs on which the cutter cones 11 are mounted. Each leg includes a journal pin 16 extending downwardly and radially inwardly on the rock bit body. The journal pin includes a cylindrical bearing surface having a hard metal insert 17 on a lower portion of the journal pin. An open groove 18 is provided on the upper portion of the journal pin. Such a groove may, for example, extend around 60% or so of the circumference of the journal pin, and the hard metal 17 can extend around the remaining 40% or so. The journal pin also has a cylindrical nose 19 at its lower end.

Each cutter cone 11 is in the form of a hollow, generally conical steel body having tungsten carbide inserts 13 pressed into holes on the external surface. For long life, the inserts may be tipped with a polycrystalline diamond layer. Such tungsten carbide inserts provide the drilling action by engaging a subterranean rock formation as the rock bit is rotated. Some types of bits have hard faced steel teeth milled on the outside of the cone instead of carbide inserts.

The cavity in the cone contains a cylindrical bearing surface including an aluminum bronze insert 21 deposited in a groove in the steel of the cone or as a floating insert in a groove in the cone. The aluminum bronze insert 21 in the cone engages the hard metal insert 17 on the leg and provides the main bearing surface for the cone on the bit body. A nose button 22 is between the end of the cavity in the cone and the nose 19 and carries the principal thrust loads of the cone on the journal pin. A bushing 23 surrounds the nose and provides additional bearing surface between the cone and journal pin.

Other types of bits, particularly for higher rotational speed applications, have roller bearings instead of the exemplary journal bearings illustrated herein.

A plurality of bearing balls 24 are fitted into complementary ball races in the cone and on the journal pin. These balls are inserted through a ball passage 26, which extends through the journal pin between the bearing races and the exterior of the rock bit. A cone is first fitted on the journal pin, and then the bearing balls 24 are inserted through the ball passage. The balls carry any thrust loads tending to remove the cone from the journal pin and thereby retain the cone on the journal pin. The balls are retained in the races by a ball retainer 27 inserted through the ball passage 26 after the balls are in place. A plug 28 is then welded into the end of the ball passage to keep the ball retainer in place.

The bearing surfaces between the journal pin and cone are lubricated by a grease composition. Preferably, the interior of the rock bit is evacuated, and grease is introduced through a fill passage (not shown). The grease thus fills the regions adjacent the bearing surfaces plus various passages and a grease reservoir. The grease reservoir comprises a cavity 29 in the rock bit body, which is connected to the ball passage 26 by a lubricant passage 31. Grease also fills the portion of the ball passage adjacent the ball retainer, the open groove 18 on the upper side of the journal pin, and a diagonally extending passage 32 therebetween. Grease is retained in the bearing structure by a resilient seal 33 between the cone and journal pin.

A pressure compensation subassembly is included in the grease reservoir 29. This subassembly comprises a metal cup 34 with an opening 36 at its inner end. A flexible rubber bellows 37 extends into the cup from its outer end. The bellows is held in place by a cap 38 with a vent passage 39. The pressure compensation subassembly is held in the grease reservoir by a snap ring 41.

When the rock bit is filled with grease, the bearings, the groove 18 on the journal pin, passages in the journal pin, the lubrication passage 31, and the grease reservoir on the outside of the bellows 37 are filled with grease. If the volume of grease expands due to heating, for example, the bellows 37 is compressed to provide additional volume in the sealed grease system, thereby preventing accumulation of excessive pressures. High pressure in the grease system can damage the seal 33 and permit abrasive drilling mud or the like to enter the bearings. Conversely, if the grease volume should contract, the bellows can expand to prevent low pressures in the sealed grease systems, which could cause flow of abrasive and/or corrosive substances past the seal.

A grease composition provided according to the practice of this invention for lubricating rock bits comprises high viscosity synthetic, i.e., nonpetroleum derived, polymer lubricant basestocks and lubricant additives for enhancing film strength and load carrying capacity, thermal stability, oxidation resistance, corrosion resistance and thickening. An exemplary grease composition is prepared by combining:

(1) synthetic polymer lubricant basestocks comprising:

(a) at least one ethylene-alphaolefin; and (b) polyisobutylene or isobutylene copolymer;

(2) a complex soap base;

(3) boron nitride extreme pressure agents; and (4) lubricant additives, if desired, for enhancing film strength and load-carrying capacity, thermal stability, oxidation resistance and corrosion resistance, and for thickening the synthetic lubricant basestocks.

An important physical property of a lubricant is its viscosity, or its resistance to flow. The viscosity of a lubrication composition determines that composition's ability to flow and form a lubricating film between opposing metal surfaces. A lubrication composition having a high viscosity generally has low flow characteristics but is a good film former once in place. A lubrication composition having a low viscosity generally has high flow characteristics but is a poor film former, especially under conditions where the opposing metal surfaces interact under conditions of extreme pressures.

The viscosity of a lubricating composition is also influenced by temperature. Generally speaking, as the temperature of lubricating composition increases, its viscosity decreases. Therefore, the composition's ability to form a lubricating film also decreases as the temperature increases. The ability of a lubricating composition to resist viscosity change under temperature is referred to as the viscosity index (VI). A lubrication composition having a VI of 100 would exhibit relatively small changes in viscosity with temperature. A lubrication composition having a VI of 0 would exhibit a relatively large change in viscosity with temperature. Many lubricants have a low VI and are unsuitable for the extreme conditions encountered in a rock bit.

In selecting a synthetic lubricant basestock for the rock bit grease composition of the present invention it is desired that the basestock have a high viscosity and a high viscosity index in order to ensure good film formation between the journal bearings throughout the temperature range of the drilling operation. For this reason, synthetic polymer lubricant basestocks are preferred over petroleum derived basestocks.

With respect to the ethylene-alphaolefin ingredient, suitable ethylene-alphaolefins include hydrocarbon-based synthetic oils of ethylene and alphaolefin that have an average number molecular weight in the range of from about 2,000 to 4,500, and having a kinematic viscosity in the range of from about 500 to 2,500 centistokes (cST) at 100° C. A preferred ethylene-alphaolefin ingredient has a kinematic viscosity within the range of from 900 to 1,400 cST at 100° C. to provide a sufficient degree of film formation throughout the operating temperatures in a rock bit. Ethylene-alphaolefin is a desirable synthetic lubricant basestock because of its combined high viscosity and excellent viscosity index (in the range of from about 200 to 400), therefore, permitting its use under varying temperature conditions with more consistent changes in film forming and lubricating ability than that provided by conventional petroleum-based lubricants.

The ethylene-alphaolefin ingredient can either be a single type of ethylene-alphaolefin polymer that displays the above-noted properties, or can be a blend of two or more different ethylene-alphaolefin polymers that when combined produce the above-noted properties. In a preferred embodiment, the ethylene-alphaolefin ingredient is formed from a blend of two different ethylene-alphaolefin polymers. A first ethylene-alphaolefin polymer is one having an average molecular weight in the range of from about 3,500 to 4,000, and having a kinematic viscosity of approximately 2,000 cST at 100° C. A preferred first ethylene-alphaolefin polymer is commercially available, for example, from Mitsui Petrochemical Industries, Ltd., of Tokyo, Japan under the product name Lucant 2000.

A second ethylene-alphaolefin polymer is one having an average molecular weight in the range of from about 400 to 800, and having a kinematic viscosity of approximately 600 cST at 100° C. A preferred second ethylene-alphaolefin polymer is commercially available, for example, from Mitsui Petrochemical Industries, Ltd., under the product name Lucant 600.

In an preferred embodiment, the ethylene-alphaolefin ingredient is formed by blending the previously described two ethylene-alphaolefin ingredients to form a mixture having a kinematic viscosity of approximately 1,200 cST at 100° C. Such a blend is achieved by mixing approximately 40 percent by weight of the first ethylene-alphaolefin polymer with approximately 60 percent by weight of the second ethylene-alphaolefin polymer, based on the total weight of the blend mixture. The blend mixture of both ethylene-alphaolefin polymers is prepared by combining a first master, that comprises the first ethylene-alphaolefin polymer, with a metal complex soap base, that comprises the second ethylene-alphaolefin polymer, as described in better detail below.

With respect to the polyisobutylene or isobutylene copolymer synthetic basestock, polyisobutylene is preferred. Polyisobutylene is a highly paraffinic rubber-like hydrocarbon polymer composed of a straight chain molecule having a Flory molecular weight in the range of from 42,000 to 68,000 and having an extremely high Brookfield viscosity in the range of from 26,000 to 35,000 centipoise (cP) at a temperature of 177° C. A particularly preferred polyisobutylene is commercially available, for example, from the Exxon Chemical Company Polymers Group of Houston, Texas under the product name Vistanex LM.

The polyisobutylene has a density of approximately 914 kilograms/cubic meter at 23° C. and is used to provide adhesiveness to the grease composition, so that it adheres to metal surfaces, e.g., bearing and journal surfaces, that it is placed in contact with. The polyisobutylene ingredient also provides high-temperature stability and improves the viscosity index of the grease composition.

It is preferred that the grease composition comprise in the range of from 1 to 20 percent by weight polyisobutylene. A grease composition comprising less than 1 percent by weight polyisobutylene may not possess the degree of adhesiveness desired to make the grease composition adhere to metal surfaces. A grease composition comprising greater than 20 percent by weight polyisobutylene will be too viscous to serve as a rock bit lubricant in low temperature applications. Other lower molecular weight polyisobutylenes may be used to prepare the grease composition of the present invention. However, the proportion of lower molecular weight polyisobutylene used to prepare the grease composition of the present invention would need to be increased.

The grease composition is prepared, according to principles of this invention, by mixing the first ethylene-alphaolefin polymer and polyisobutylene ingredient together to form a first master. In a preferred embodiment, the first master comprises in the range of from 95 to 99 percent by weight of the first ethylene-alphaolefin polymer, and in the range of from 1 to 5 percent by weight of the polyisobutylene ingredient. A first master comprising an amount of the first ethylene-alphaolefin ingredient outside of this range will produce a grease composition that has a viscosity too low for application in a rock bit, if more than 99 percent by weight is used, and will produce viscosity too high for application in a rock bit, if less than 95 percent by weight is used. A first master comprising an amount of the polyisobutylene ingredient outside of this range will produce a grease composition having a degree of adhesion not well suited for application in a rock bit, if too little is used, and will produce a grease composition that is too viscous to serve as a rock bit lubricant in low temperature applications, if too much is used.

A complex base soap is prepared by combining a metal ingredient selected from the group including alkali-metal, and alkaline-earth metal hydroxides, with one or more fatty acid, and the second ethylene alphaolefin ingredient. The complex base soap, prepared according to principles of this invention, provides a heat resistant thickener to the grease composition that is shear stable and is excellent for high-speed rock bit bearing performance.

With respect to the metal ingredient, alkali-metal hydroxides are preferred. A particularly preferred alkali-metal hydroxide is lithium hydroxide. Lithium hydroxide is preferred because it produces a complex soap base that is most stable under rock bit operating conditions, and provides a high degree of water resistance. It is desired that the complex soap base comprise in the range of from one to five percent by weight of the lithium hydroxide ingredient. A complex soap base formed by using an amount of lithium hydroxide outside of this range will produce a complex soap base having a degree of stability and water resistance not well suited for a rock bit lubricant. In a preferred embodiment, the complex soap base is prepared by using approximately three percent by weight of the lithium hydroxide ingredient, based on the total complex soap base composition.

With respect to the fatty acid ingredient, suitable fatty acid ingredients include those selected from the group of fatty acids having in the range of from 5 to 20 carbon atoms. The fatty acid serves as a saponifying agent to facilitate a saponification reaction with the lithium hydroxide ingredient. The saponification reaction results in the in-situ formation of complex alkali-metal complex soap structures that serve as thickening agents for the grease composition. A fatty acid ingredient having a number of carbon atoms outside of this range will not provide a desired degree of saponification and, thus produce a grease that is not well suited for use as a rock bit grease.

In a preferred embodiment, the soap complex base is prepared by using two different fatty acids. A preferred first fatty acid ingredient is one having in the range of from 15 to 10 carbon atoms. A particularly preferred first fatty acid ingredient is an hydroxy steric acid, i.e., a fatty acid comprising a chain molecule having approximately 18 carbon atoms, where the hydroxyl (OH) group is bonded with the 12th carbon atom. Such preferred first fatty acid is referred to as 12-hydroxy steric acid. The 12-hydroxy steric acid is preferred because it is naturally occurring, thus readily available, and because it provides a desired degree of saponification that displays excellent oxidation and shear stability. It is desired that the complex soap base comprise in the range of from 5 to 15 percent by weight of the first fatty acid ingredient. In a preferred embodiment, the complex soap base is prepared by using approximately ten percent by weight of the first fatty acid ingredient, based on the total complex soap base composition.

A preferred second fatty acid ingredient is one having in the range of from 5 to 12 carbon atoms. A particularly preferred second fatty acid ingredient is azelaic acid, i.e., a chain molecule having approximately 9 carbon atoms, available from, for example Henkle Corp., of Cincinnati, Ohio under the product name Emmerox 1144. The azelaic acid contributes to the saponification of the lithium hydroxide to produce a desired soap complex base. It is desired that the complex soap base comprise in the range of from one to five percent by weight of the second fatty acid ingredient. In a preferred embodiment, the complex soap base is prepared by using approximately three percent by weight of the second fatty acid ingredient, based on the total soap base composition.

A complex soap base formed by using an amount of the first and second fatty acids outside of the respective ranges will not produce a desired degree of saponification and, thus will not produce a desired amount of metal complex soap structures to serve as thickening agents for the grease composition to support application in a rock bit.

The second ethylene-alphaolefin ingredient is used to form the complex soap base to facilitate forming a stable network grease structure with the first master, which comprises a major proportion of the first ethylene-alphaolefin ingredient. It is desired that the complex soap base comprise in the range of from 75 to 90 percent by weight of the second ethylene-alphaolefin ingredient to promote a desired degree of mixing. A complex soap base formed by using an amount of the second ethylene-alphaolefin ingredient outside of this range will produce a complex soap base that is not capable of forming a stable network grease structure upon mixing with the first master to be useful in rock bit applications. In a preferred embodiment, the complex soap base is prepared by using approximately 80 percent by weight of the second ethylene-alphaolefin ingredient, based on the total complex soap base composition.

The complex soap base is formed by combining the alkali-metal oxide, the fatty acid(s), and second ethylene-alphaolefin ingredients together, stirring the combined mixture, and heating the combined mixture to a temperature of approximately 200° C. for approximately 45 minutes. During this period, a saponification reaction takes place, resulting in the in-situ formation of alkali-metal complex soap structures, which serve as the thickening agent for the grease composition. The alkali-metal complex soap structures are desirable because they are shear stable at high temperatures, thereby contributing shear stability to the grease composition.

A key feature of the grease composition, prepared according to principles of this invention, is that it does not contain thickening agents formed from fine silica, silica gel, or graphite. Rather, the only thickening agents used in the grease composition are the alkali metal complex soap structures formed from the saponification reaction produced by combining the complex soap base ingredients. Silica and graphite are not desired thickening agents because they have been found to be abrasive on the journal bearings of the rock bit, thereby shortening rock bit service life. Grease compositions of this invention, prepared without silica or graphite thickening agents, thus extend the service life of the rock bit.

The first master and the complex soap base are combined together after the complex soap base has been allowed to cool to a temperatures of approximately 35° C. to 60° C. The warm complex soap base, when combined with the first master, helps to promote mixing, while the relatively cooler first master helps to promote further cooling of the complex soap base. The step of premixing the second ethylene-alphaolefin with the other ingredients used to form the complex soap base, and then mixing the complex soap base with the first master, containing the first ethylene-alphaolefin, is important to the formation of a stable network grease structure.

Another key feature of the rock bit grease composition, prepared according to principles of this invention, is the use of an extreme pressure agent comprising solid particles, rather than an extreme pressure agent consisting of a non-solid sulfur-based compound. An extreme pressure agent formed from solid particles is preferred for use in rock bits over an sulfur-based nonsolid extreme pressure agents because the solid particles are not harmful to elastomeric materials in the rock bit, such as seals and boots, at high temperatures. Extreme pressure agents that comprise sulfur-based compounds have been found to cause additional curing of nitrile rubber used as seals and boots in rock bits, causing them to lose their elastomeric properties and ultimately tear and fail. Use of nonsulfur type solid extreme pressure agents thus helps to extend rock bit service life by reducing the possibility of seal induced rock bit seal failure.

The grease composition of this invention is prepared by adding the solid extreme pressure additive, and other lubricant additives, to the combined first master and the complex soap base. The grease composition may comprise in the range of from 45 to 55 percent by weight of the first master, and in the range of from 35 to 45 percent by weight complex soap base. Using an amount of the first master outside of this range will produce a grease composition having a reduced film forming capability, when too little is used, and will produce a grease composition having a reduced load carrying capability, when too much is used. In a preferred embodiment, the grease composition comprises approximately 50 percent by weight of the first master and approximately 40 percent by weight of the complex soap base, and the remaining amount solid extreme pressure additive and other lubricant additives.

A preferred solid extreme pressure agent is hexagonal boron nitride (hBN) powder. HBN powder is preferred because, unlike solid extreme pressure agents formed from metals such as lead and the like, it is environmentally safe and nontoxic. Additionally, hBN powder has been found to be more effective in increasing the load bearing capability of the grease composition that other solid particle additives, e.g., copper powder. The hBN powder is combined with the synthetic polymer lubricant basestocks and the complex soap base as an extreme pressure additive (EPA) for enhancing the film strength and load carrying capacity of the grease composition. The hBN powder can have nearly any particle size and/or particle size distribution.

It is desired that the hBN powder have a high purity, e.g., so that approximately 99 percent of the hBN particles have an average particle size of 325 mesh. A particularly preferred hBN powder is commercially available, for example, from Advanced Ceramics Corporation of Cleveland, Ohio as grade HCLP hBN powder, having a mean particle size of in the range of from 8 to 11 micrometers, an average surface area of approximately 7 meters$^2$/g, and an average density of approximately 0.5 g/cc.

It is desired that the grease composition comprise in the range of from 1 to 5 percent by weight hBN powder. A grease composition comprising an amount of hBN powder outside of this range will not provide a desired degree of load carrying ability, if too little is used, and will interfere with the lubricating properties of the composition, i.e., be abrasive, if too much is used. In a preferred embodiment, the grease composition comprises approximately two percent by weight of the hBN powder.

The rock bit grease composition additionally comprises a molybdenum disulfide ($MoS_2$) lubricant additive. The $MoS_2$ is used in forming the grease composition because of its excellent lubricating properties, acting together with the hBN to produce a grease composition having a desired degree of load carrying capability. A particularly preferred $MoS_2$ is one available from, for example, Climax Molybdenum Company of Ypsilanti, Mich. It is desired that the grease composition comprise in the range of from five to ten percent by weight of the $MoS_2$ ingredient. In a preferred embodiment, the grease composition comprises approximately seven percent by weight of the $MoS_2$ ingredient.

Although the $MoS_2$ ingredient contains sulfur atoms, due to its hexagonal crystalline structure, the $MoS_2$ ingredient is chemically inert and does not react with the nitrile seals and boots of the rock bit to cause further curing. The $MoS_2$ ingredient does not, therefore, induce seal and boot related rock bit failures like other conventional sulfur-containing lubricants and/or extreme pressure agents.

The rock bit grease composition may optionally comprise an anti-seize agent. Suitable anti-seize agents include metal compounds or metal powders formed from non-toxic and environmentally safe metals. A preferred anti-seize agent is one formed from copper powder. A particularly preferred copper powder is one available from, for example, MD Both Co., of Ashland, Mass. under the trade name MD30L, which is copper leaf powder having an average particle size of approximately 35 microns, and having an aspect ratio (diameter/thickness) of approximately 50:1. It is desired that the grease composition comprise up to about five percent by weight of the anti-seize agent. In a preferred embodiment, the grease composition comprises approximately two percent by weight of the anti-seize agent.

The principal portion of the grease composition is made up of the synthetic lubricant basestocks, in the form of the first ethylene-alphaolefin and polyisobutylene, in the first master, and in the form of the second ethylene-alphaolefin, in the complex soap base. The synthetic lubricant basestocks serve to provide the basic lubricity to the grease composition. A preferred grease composition comprises greater than 75 percent by weight of the synthetic lubricant basestock. Synthetic lubricant basestocks are preferred over petroleum derived mineral oil basestocks because of their increased viscosity and high viscosity index (VI). However, high viscosity petroleum derived basestocks may also be used in the practice of this invention. Selecting synthetic lubricant basestocks having such viscosity characteristics permits the formulation of a rock bit grease composition having a desired degree of lubricant film strength and load carrying capacity.

The grease composition comprises synthetic lubricant basestocks in the range of from 75 to 90 percent by weight of the total grease composition. A grease composition comprising less than 75 percent by weight synthetic lubricant basestocks may not possess the basic lubricity needed to provide a desired degree of rock bit lubrication. A grease composition comprising greater than about 90 percent by weight synthetic lubricant basestocks will not contain a sufficient quantity of extreme pressure agents and other lubricant additives needed to produce a grease composition having the desired degree of lubrication film strength and load-carrying capacity for operation at the high temperatures and pressures encountered in rock bit bearings.

The grease composition may also comprise a number of different lubricant additives for enhancing the thermal stability, oxidation resistance, corrosion resistance, and/or for lowering the pour point of the grease composition.

The rock bit grease composition is prepared by combining together the first master with the complex soap base, and then adding the hBN powder, $MoS_2$ ingredient, anti-seize agent and any other desired lubricant additive agents to the combined first master and complex soap base mixture. The hBN powder, $MoS_2$ ingredient, anti-seize agent and other optionally desired lubricant additives are added to the combined first master and complex soap base mixture at room temperature and are blended in a mixer to disperse lumps and to obtain a homogeneous mixture. A rock bit grease composition, prepared according to principles of this invention, has a Brookfield viscosity at 120° C. in the range of from about 600 to 750 cP, and has a viscosity index of approximately 200.

The grease composition displays these viscosity characteristics without the need for using toxic or environmentally unsafe extreme pressure additives, without using sulfur-containing extreme pressure agents, and without using silica- or graphite-based thickening agents, that may damage and ultimately cause premature failure of the rock bit seals.

The grease composition, prepared according to principles of this invention, can be better understood by reference to the following example.

EXAMPLE

A grease composition was prepared by combining approximately 98.25 percent by weight Lucant 2000 (first ethylene-alphaolefin) and approximately 1.75 percent by weight Vistanex LM (polyisobutylene) synthetic lubricant basestocks, to form a first master. A complex soap base was prepared by combining approximately 3.2 percent by weight lithium hydroxide, 3.2 percent by weight Emmerox 1144 (second fatty acid), 10 percent by weight 12-hydroxy stearic acid (first fatty acid), and 83.6 percent by weight Lucant 600 (second ethylene-alphaolefin). The ingredients combined to form the complex soap base were stirred together and heated to a temperature of approximately 200° C. for 45 minutes to effect saponification. After being allowed to cool, the complex soap base was combined with the first master in a ratio of approximately 1:1.3, respectively. Added to the combined first master and the complex soap base, in the proportions set forth in Table 1 below, was AC-6004 (hBN powder), $MoS_2$ and MD-30L (copper powder).

TABLE 1

| Material | Specific Gravity | Density (lb/gal) | Weight Percent | Volume (gal) |
|---|---|---|---|---|
| First Master | 0.85 | 7.08 | 49.98 | 7.06 |
| Complex Soap Base | 0.91 | 7.6 | 39.27 | 5.17 |
| Molybdenum Disulfate ($MoS_2$) | 4.96 | 41.27 | 7 | 0.17 |
| Copper Powder (MD-30L) | 8.90 | 20.65 | 2 | 0.09 |
| hBN Powder (AC-6004) | 2.27 | 18.89 | 1.75 | 0.09 |

The grease composition prepared in the example displayed a Brookfield viscosity at 120° C. in the range of from 600 to 750 cP without the need for using extreme pressure or agents or lubricant additives known to adversely affect the rock bit sealing arrangement, or that could pose a toxic health danger or environmental hazard. Conventional rock bit grease compositions have a viscosity at 120° C. of approximately 180 cP. The grease composition of this invention has a viscosity of greater than four times that of conventional grease composition, which demonstrates the superior lubricating capabilities of the grease composition of this invention.

Samples of the grease composition that were prepared according to the above-described example were subjected to four ball testing, according to ASTM D-2596, to evaluate the load bearing capability of the grease. Conventional rock bit grease compositions display a four ball test load of approximately 620 kilograms (kg). A grease composition having a four ball test load of 620 Kg is one that is incapable of preventing the welding together of at least two balls when subjected to a load of 620 Kg for a period of 10 seconds. The grease composition of this invention displayed a four ball test load of approximately 800 Kg (min), which demonstrates the superior load bearing capability of such grease composition when compared with conventional-type grease compositions kilograms.

Samples of the grease composition were also subjected to load friction wear tests, according to ASTM standards, that evaluated the grease composition's ability to resist friction induced wear. The load friction test permits calculation of such data as the coefficient of friction and the wear loss. The coefficient of friction calculated for conventional rock bit grease compositions was approximately 0.09, while the coefficient of friction calculated for grease compositions of this invention was approximately 0.07. The reduced coefficient of friction demonstrates the superior lubricating capability of the grease composition of this invention when compared to conventional grease compositions.

The wear loss calculated for conventional grease composition was approximately 0.08 inches, while the wear loss calculated for the grease composition of this invention was approximately 0.05. The reduced wear loss again demonstrates the superior lubricating capability of the grease composition of this invention when compared to conventional grease compositions.

The grease composition according to this invention also underwent a radial bearing test, which is a test used to evaluate the lubricating properties of the grease under conditions designed to resemble down hole conditions encountered during the actual use of a rock bit. A conventional rock bit grease composition was subjected to the radial bearing test under a test load of approximately 2,500 pounds, and a rotational speed of approximately 950 rpms. The conventional grease composition failed to provide sufficient lubrication after only one hour, while the grease composition of this invention provided sufficient lubrication for over 18 hours or over one million cycles. Lubrication failure was reflected by a sudden spike in the measured torque and temperature during the test. The ability of the grease composition of this invention to provide sufficient lubricating properties for more than 18 times the duration of conventional grease composition demonstrates the superior lubricating properties of such grease composition.

The grease composition of this invention was also tested for drop point, i.e., the temperature at which the thickener of the grease melts. This is a measure of lubricant temperature capability. Conventional grease compositions displayed a drop point of approximately 384° F., while grease compositions of this invention displayed a drop point of approximately 493° F., i.e., more that 100° F. The elevated drop point for the grease composition of this invention demonstrates its superior viscosity retention at high temperatures when compared to conventional grease compositions.

Although limited embodiments of rock bit have been described herein, many modifications and variations will be apparent to those skilled in the art. The exemplary bit described and illustrated is no more than that; there are a variety of bit configurations known in which the grease composition may be used. Accordingly, it is to be understood that rock bit grease compositions of the present invention may be used with rock bits other than that specifically described herein.

It is also to be understood within the scope of the present invention that the grease composition may comprise a variety of other lubricant additives than specifically described. For example, the grease composition may comprise other types of extreme pressure agents, corrosion inhibitors, oxidation inhibitors, anti wear inhibitors or thickening agents. The grease composition may include additional lubricant additives such as graphite to enhance the lubrication characteristics of the present invention. Additionally, the grease composition may comprise lubricant additives not specifically described such as water repellents, anti foam agents, color stabilizers, odor control agents and the like.

It is also to be understood within the scope of this invention that the rock bit grease composition may comprise lubricant basestocks other than that specifically described in the preferred embodiment. Additionally, the lubricant basestocks may include fluorosilicone compounds or high viscosity paraffinic non-naphthenic petroleum polymers. These alternative lubricant basestocks may be combined with either the lubricant additives specifically defined in the preferred embodiment or with alternative lubricant additives to achieve the desired lubrication characteristics for use is a rock bit.

It is therefore to be understood that, within the scope of the appended claims, this invention may be practiced otherwise than as specifically described.

What is claimed is:

1. A rock bit for drilling subterranean formations comprising:

a bit body including a plurality of journal pins, each having a bearing surface;

a cutter cone mounted on each journal pin and including a bearing surface;

a grease reservoir in communication with such bearing surfaces;

a grease composition in the grease reservoir and adjacent the bearing surfaces, wherein the grease composition is silica free and has a viscosity greater than 500 centistokes at 120° C., the grease composition comprising:
synthetic polymer lubricant basestocks;
a metal complex soap base thickener; and
a boron nitride extreme pressure agent.

2. A rock bit as recited in claim 1 wherein the grease composition comprises in the range of from 75 to 90 percent by weight synthetic polymer lubricant basestocks.

3. A rock bit as recited in claim 1 wherein the synthetic polymer lubricant basestocks comprise:

at least one ethylene-alphaolefin polymer; and polyisobutylene.

4. A rock bit as recited in claim 3 wherein the grease composition comprises:

a first ethylene-alphaolefin polymer having an average molecular weight in the range of from about 3,500 to 4,000;

a second ethylene-alphaolefin polymer having an average molecular weight in the range of from about 400 to 800; and a polyisobutylene polymer having a Flory molecular weight in the range of from 42,000 to 68,000.

5. A rock bit as recited in claim 4 wherein the grease composition comprises a first master formed from the first ethylene-alphaolefin polymer and the polyisobutylene, and wherein the metal complex soap base thickener comprises a major proportion of the second ethylene-alphaolefin polymer.

6. A rock bit as recited in claim 4 wherein metal ingredient used to form the metal complex soap base thickener is selected from the group consisting of alkali-metal hydroxides, and alkaline-earth metal hydroxides, and wherein the metal complex soap base thickener additionally comprises at least one fatty acid.

7. A rock bit as recited in claim 6 wherein the metal complex soap base thickener comprises:

a first fatty acid having in the range of from 15 to 20 carbons atoms; and a second fatty acid having in the range of from 5 to 12 carbon atoms.

8. A rock bit as recited in claim 7 wherein the metal ingredient is lithium hydroxide, and wherein the first fatty acid is 12-hydroxy stearic acid, and wherein the second fatty acid is azelaic acid.

9. A rock bit as recited in claim 7 wherein the metal complex soap base thickener comprises in the range of from 1 to 5 percent by weight alkali-metal hydroxide, 75 to 90 percent by weight second ethylene-alphaolefin, 5–15 percent by weight first fatty acid, and 1 to 5 percent by weight second fatty acid.

10. A rock bit as recited in claim 5 wherein the grease composition additionally comprises molybdenum disulfide.

11. A rock bit as recited in claim 10 wherein the grease composition comprises in the range of from 45 to 55 percent by weight combined polyisobutylene polymer and first ethylene-alphaolefin, 35–45 percent by weight metal complex soap base thickener, 1 to 5 percent by weight boron nitride extreme pressure agent, and 5–10 percent by weight molybdenum disulfide.

12. A rock bit as recited in claim 1 wherein the grease composition further comprises copper powder anti-seize agent.

13. A rock bit as recited in claim 1 wherein the boron nitride extreme pressure agent is boron·nitride powder having a mean particle size in the range of from 8 to 11 micrometers.

14. A rock bit for drilling subterranean formations comprising:

a bit body including a plurality of journal pins, each having a bearing surface;

a cutter cone mounted on each journal pin and including a bearing surface;

a grease reservoir in communication with such bearing surfaces;

a grease composition in the grease reservoir and adjacent the bearing surfaces, wherein the grease composition is silica free and has a Brookfield viscosity at 120° C. in the range of from about 600 to 750, the grease composition comprising:
a major proportion of synthetic polymer lubricant basestocks selected from the group consisting of ethylene-alphaolefin polymers, and polyisobutylene polymers, and mixtures thereof;

a metal complex soap base thickener comprising:

a metal ingredient selected from the group consisting of alkali-metal, and alkaline-earth metal hydroxides; and one or more fatty acid; and an hexagonal boron nitride extreme pressure agent.

15. A rock bit as recited in claim 14 wherein the synthetic polymer lubricant basestocks comprise:

a blend of at least two different ethylene-alphaolefin polymers, wherein the blend has a viscosity at 100° C. in the range of from 900 to 1,400; and a polyisobutylene polymer having a Flory molecular weight in the range of from 42,000 to 68,000.

16. A rock bit as recited in claim 15 wherein the blend of ethylene-alphaolefin polymers comprises:

a first ethylene-alphaolefin polymer having an average molecular weight in the range of from 3,500 to 4,000; and a second ethylene-alphaolefin polymer having an average molecular weight in the range of from 400 to 800, and wherein the second ethylene-alphaolefin polymer forms a major proportion of the metal complex soap base thickener.

17. A rock bit as recited in claim 16 wherein the metal ingredient used to form the metal complex soap base thickener is an alkali-metal hydroxide, and wherein the metal complex soap base thickener comprises a blend of fatty acids comprising:

a first fatty acid having in the range of from 15 to 20 carbon atoms; and a second fatty acid having in the range of from 5 to 12 carbon atoms.

18. A rock bit as recited in claim 14 wherein the grease composition comprises in the range of from 75 to 90 percent by weight synthetic polymer lubricant basestocks, 35 to 45 percent by weight metal complex soap base thickener, and 1 to 5 percent by weight hexagonal boron nitride powder.

19. A rock bit as recited in claim 18 wherein the grease composition additionally comprises molybdenum disulfide and a copper powder anti-seize agent.

20. A rock bit as recited in claim 17 wherein the grease composition comprises in the range of from 5 to 10 percent by weight molybdenum disulfide, and up to 5 percent by weight copper powder.

21. A grease composition for use in a rock bit comprising:

synthetic polymer lubricant basestocks comprising:

polyisobutylene having a Flory molecular weight in the range of from 42,000 to 63,000;

a blend of ethylene-alphaolefin polymers having a blend viscosity in the range of from 900 to 1,400 centistokes at 100° C.;

a metal complex soap base thickener comprising:

a metal ingredient selected from the group consisting of alkali-metal, and alkaline-earth metal hydroxides, and mixtures thereof;

at least one fatty acid; and hexagonal boron nitride extreme pressure agents; and molybdenum disulfide.

22. A grease composition as recited in claim 21 wherein the blend of ethylene-alphaolefin polymers comprises:

a first ethylene-alphaolefin polymer having a molecular weight in the range of from 3,500 to 4,000; and a second ethylene-alphaolefin polymer having a molecular weight in the range of from 400 to 800, wherein the second ethylene-alphaolefin is used to form the metal complex soap base thickener.

23. A grease composition as recited in claim 22 wherein the metal ingredient used to form the complex soap base thickener is lithium hydroxide, and wherein the complex soap base thickener formed from a fatty acid blend comprising:

a first fatty acid having in the range of from 15 to 20 carbon atoms; and a second fatty acid having in the range of from 5 to 12 carbon atoms.

24. A grease composition as recited in claim 23 wherein the metal complex soap base thickener comprises in the range of from 1 to 5 percent by weight of the lithium hydroxide, 5 to 15 percent by weight of the first fatty acid, 1 to 5 percent by weight of the second fatty acid, and 75 to 90 percent by weight of the second ethylene-alphaolefin polymer.

25. A grease composition as recited in claim 23 comprising in the range of from 45 to 55 percent by weight of the combined first ethylene-alphaolefin polymer and polyisobutylene polymer, 35 to 45 percent by weight metal complex soap base thickener, one to 5 percent by weight hexagonal boron nitride powder, 5 to 10 percent by weight molybdenum disulfide, and up to five percent copper powder.

26. A grease composition as recited in claim 21, where in the grease composition is silica free and has a viscosity at 120° C. greater than 500 centipoise.

27. A method for preparing a grease composition for use in a rock bit comprising the steps of:

combining synthetic polymer lubricant basestocks comprising:

a polyisobutylene polymer; with an ethylene-alphaolefin polymer having a molecular weight in the range of from 3,500 to 4,000 to form a first master;

combining:

a metal ingredient selected from the group consisting of alkali-metal hydroxides, and alkaline-earth metal hydroxides; with at least one fatty acid; and an ethylene-alphaolefin polymer having a molecular weight in the range of from 400 to 800 to form a complex soap base thickener;

heating the complex soap base thickener to effect saponification;

mixing together the first master and the complex soap base thickener to form a mixture;

adding a boron nitride extreme pressure agent and molybdenum disulfide to the mixture to form the grease composition.

28. A method as recited in claim 27 wherein the first master is formed by combining:

a major proportion of the ethylene-alphaolefin polymer having a molecular weight in the range of from 3,500 to 4,000; with a minor proportion of the polyisobutylene polymer.

29. A method as recited in claim 27 wherein the complex soap base thickener is formed by combining:

a major proportion of the ethylene-alphaolefin having a molecular weight in the range of from 400 to 800; with an alkali-metal hydroxide; with a first fatty acid having in the range of from 15–20 carbon atoms; and a second fatty acid having in the range of from 5–12 carbon atoms.

30. A method as recited in claim 27 wherein during the step of adding boron nitride extreme pressure agent, sufficient boron nitride is added so that the grease composition comprises boron nitride in the range of from 1 to 5 percent by weight of the total composition.

31. A method as recited in claim 27 further comprising the step of adding copper powder anti-seize agent to the mixture, wherein sufficient copper powder is added so that the grease composition comprises copper powder up to 5 percent by weight of the total composition.

32. A method for making a silica-free grease composition for use in rock bits comprising the steps of:

combining a polyisobutylene polymer, with a first ethylene-alphaolefin having a molecular weight in the range 3,500 to 4,500 to form a first master;

combining a second ethylene-alphaolefin having a molecular weight in the range of from 400 to 800, with a metal ingredient selected from the group consisting of alkali-metal hydroxides, and alkaline-earth metal hydroxides, and at least one fatty acid to form a complex soap base thickener;

heating the complex soap base thickener to effect in-situ saponification;

combining the first master and the metal complex soap base thickener together to form a mixture; and adding boron nitride extreme pressure agents, molybdenum disulfide, and copper powder anti-seize agent to the mixture to form a grease composition having a viscosity in the range of from 600 to 750 centipoise at 120° C.

33. The method as recited in claim 32 wherein during the step of forming the first master a major proportion of the first ethylene-alphaolefin is used.

34. The method as recited in claim 32 wherein during the step of forming the complex soap base thickener a major proportion of the second ethylene-alphaolefin is used, and wherein the metal ingredient is lithium hydroxide.

35. The method as recited in claim 32 wherein during the step of forming the complex soap base thickener the combined ingredients are heated to a temperature greater than 200° C. for a period of greater than 30 minutes to effect saponification.

* * * * *